US005220901A

United States Patent [19]

Morita et al.

[11] Patent Number: 5,220,901

[45] Date of Patent: Jun. 22, 1993

[54] CAPACITOR DISCHARGE IGNITION SYSTEM WITH INDUCTIVELY EXTENDED DISCHARGE TIME

[75] Inventors: Shingo Morita; Takafumi Narishige; Mitsuru Koiwa, all of Himeji, Japan

[73] Assignee: Mitsubishi Denki Kabushiki Kaisha, Tokyo, Japan

[21] Appl. No.: 925,647

[22] Filed: Aug. 7, 1992

[30] Foreign Application Priority Data

Oct. 9, 1991 [JP] Japan ..... 3-262289

[51] Int. Cl.[5] ..... F02P 3/08

[52] U.S. Cl. ..... 123/604; 123/620; 123/656

[58] Field of Search ..... 123/598, 604, 605, 620, 123/656

[56] References Cited

U.S. PATENT DOCUMENTS 4,922,883 5/1990 Iwasaki ..... 123/598
5,131,376 7/1992 Ward et al. ..... 123/598

FOREIGN PATENT DOCUMENTS 53-14820 4/1978 Japan .
53-30591 7/1978 Japan .
53-51953 12/1978 Japan .

*Primary Examiner*—Tony M. Argenbright
*Attorney, Agent, or Firm*—Sughrue, Mion, Zinn, Macpeak and Seas

[57] ABSTRACT

A capacitor discharge ignition device for an internal combustion engine includes a booster coil 21 and a transistor 22 for generating a boosted voltage; a circuit 15A for generating a switching signal for the transistor in response to an ignition signal; first and second condensers 7, 8 for charging with the boosted voltage; an ignition coil 10 to whose secondary a spark plug is connected; a thyristor 13 forming a first closed discharge circuit with the first condenser and the ignition coil primary, which is turned on in synchronism with the ignition signal; and an inductor 9 forming a second closed circuit with the second condenser, the ignition coil primary and the thyristor. The discharge energy of the second condenser stored in the inductor is supplied to the ignition coil primary to extend the discharge time at the spark plug. A delay circuit 16 prevents the transistor from turning on during the extended discharge time, thus establishing a third closed inductor discharge path through the booster coil.

3 Claims, 6 Drawing Sheets

CAPACITOR DISCHARGE IGNITION SYSTEM WITH INDUCTIVELY EXTENDED DISCHARGE TIME

BACKGROUND OF THE INVENTION

Field of the Invention

This invention relates to a capacitor-discharge-type ignition device for an internal combustion engine which extends the discharge time by using a closed circuit, and particularly to such an ignition device achieving cost reduction and downsizing thereof by reducing the number of parts.

Discussion of Background

Conveniently, a capacitor-discharge-type ignition device for an internal combustion engine (CDI) generates discharge in an ignition plug by charging a previously-boosted voltage in a condenser, and by discharging the boosted voltage to the primary side of an ignition coil from the condenser.

In such an ignition device, a closed circuit for maintaining discharge including an inductor is provided in parallel with the primary side of the ignition coil to prevent, especially, a misfire during cold starting, thereby extending the discharge time at the ignition plug (which is an LCDI).

FIG. 6 is a construction diagram showing a conventional ignition device for an internal combustion engine composed of an LCDI, wherein reference numeral 1 designates a battery, and numeral 2 designates a booster circuit for boosting an output voltage of the battery 1, including a booster coil 21 and a first switching element, that is, a power transistor 22 for generating a boosted voltage from the booster coil 21 by repetitively flowing and breaking current in the booster coil 21.

A numeral 3 designates an ignition signal generating circuit for forming an ignition signal G composed of timing pulses, 4, a trigger circuit for forming a trigger signal T at the fall of the ignition signal G, 5 and 6, diodes connected in parallel with an output terminal of the booster circuit 2 for passing the boosted voltage from the booster circuit 2, 7 and 8, first and second condensers (hereinafter respectively condensers) for individually charging the boosted voltage which passes through the respective diodes 5 and 6, and 9, an inductor interposed between terminals on the charging sides of the respective condensers 7 and 8 for storing a discharge energy of the condenser 8 to extend the discharge time.

A numeral 10 designates an ignition coil to the primary side of which the boosted voltage from the respective condensers 7 and 8 is supplied, 11, an ignition plug connected to the secondary side of the ignition coil 10, 12, a diode for checking inverse flow to prevent a current vibration on the primary side of the ignition coil 10, and 13, a second switching element, that is, a thyristor interposed between the primary side of the ignition coil 10 and the battery 1, which is fired by the trigger signal T.

A numeral 14 designates a diode interposed between a junction point of the primary side of the ignition coil 10 and the thyristor 13, and a junction point of the condenser 8 and the inductor 9, forming a closed circuit for maintaining discharge with the inductor 9 and the primary side of the ignition coil 10.

Furthermore, the condenser 7, the primary side of the ignition coil 10 and the thyristor 13 compose a first closed circuit for discharge, and the condenser 8, the inductor 9, the primary side of the ignition coil 10 and the thyristor 13 compose a second closed circuit for discharge.

A numeral 15 designates a driving signal generating circuit for forming a driving signal D to repetitively switch the power transistor 22 on and off in response to the ignition signal G, which re-charges the boosted voltage from the booster circuit 2 to the condensers 7 and 8 after discharge.

Next, an explanation will be given of the operation of the conventional ignition device for an internal combustion engine shown in FIG. 6 referring to the waveform diagrams of FIG. 7.

Normally, a predetermined boosted voltage is charged in the respective condensers 7 and 8 by the booster circuit 2. In this situation, when the ignition signal G at a predetermined ignition timing is formed by the ignition signal generating circuit 3 in response to a requirement of the internal combustion engine, the trigger signal T is formed by the trigger circuit 4 at the fall of each ignition signal pulse.

By this trigger signal, the thyristor 13 is fired. The charged voltage of the condenser 7 is rapidly discharged through the first closed circuit for discharge, that is, the primary side of the ignition coil 10 and the thyristor 13, which generates a high voltage on the second side of the ignition coil 10. Similarly, the charged voltage of the condenser 8 is discharged through the second closed circuit for discharge, that is, the inductor 9, the primary side of the ignition coil 10 and the thyristor 13.

The thyristor 13 is turned off when the discharge current from the condensers 7 and 8 is lowered to a conductivity maintaining current thereof or less.

At this moment, the discharge energy of the condenser 8 stored in the inductor 9 maintains a current through the primary side of the ignition coil 10 and the diode 14, even after the discharge of the condensers 7 and 8 is finished.

Accordingly, a discharge is generated at the ignition plug 11 connected to the secondary side of the ignition coil 10 at the fall of the ignition signal G. Furthermore, the discharge time is extended while the current in the inductor 9 is maintained, thereby performing the required ignition with certainty. For instance, the discharge time of the condenser 7 through the thyristor 30 is about 100 $\mu$ second, whereas the discharge time of the closed circuit for maintaining discharge is about 1.5 m second.

On the other hand, in discharging the condensers 7 and 8, the driving signal generating circuit 15 intermittently forms the driving signal D in synchronism with the fall of the ignition signal G, and switches the power transistor 22 in the booster circuit 2.

In this way, an input current to the booster coil 21 synchronized with the driving signal D, is supplied by the battery 1. The boosted voltage is generated from the booster coil 21 during the fall of the respective input currents. The boosted voltage is repetitively charged to the condensers 7 and 8 through the diodes 5 and 6.

However, normally, a plurality of cylinders are provided in an internal combustion engine each having an ignition coil 10, an ignition plug and a thyristor 13, which are connected in parallel to the circuit including the condensers 7 and 8 and the inductor 9.

In this case, since the diode 14 in the closed circuit for maintaining discharge is commonly utilized, the current for maintaining discharge flows to the ignition coils 10 of all the cylinders.

To prevent such a wasteful power consumption of the current for maintaining discharge, it is necessary to interpose a switching element such as a thyristor in place of the diode 14 in the closed circuit for maintaining discharge and to individually provide the switching element for every cylinder. The number of circuit elements thus becomes considerable, and the cost reduction and downsizing can not be achieved.

SUMMARY OF THE INVENTION

It is an object of the present invention to provide an ignition device for an internal combustion engine dispensing with diodes (or thyristors) in the closed circuit for maintaining discharge, and achieving cost reduction and downsizing.

According to an aspect of the present invention, there is provided an ignition device for an internal combustion engine: having a booster means including a booster coil and a first switching element for generating a boosted voltage from the booster coil; a driving signal generating circuit for forming a driving signal for driving the first switching element for boosting in response to an ignition signal; first and second condensers for charging the boosted voltage in response to the booster means; an ignition coil to whose secondary side an ignition plug is connected; a second switching element composing a first closed circuit for discharge with the first condenser and a primary side of the ignition coil which is turned on in synchronism with the ignition signal; an inductor forming a second closed circuit with the second condenser, the primary side of the ignition coil and the second switching element; and a rectifying element connected to the primary side of the ignition coil. Discharge is generated in the ignition coil by discharging a charged voltage of the first and second condensers in synchronism with the ignition signal, and a discharge energy of the second condenser stored in the inductor is supplied to the primary side of the ignition coil thereby extending a time for maintaining discharge at the ignition plug. A delay means prevents the turning on of the first switching element during the time for maintaining discharge by outputting a delay pulse in synchronism with the ignition signal to the driving signal generating circuit, thus establishing a third closed circuit for maintaining discharge through the booster coil, the inductor, the primary side of the ignition coil and the second switching element.

According to a second aspect of the present invention, there is provided an ignition device for an internal combustion engine according to the first aspect, further comprising a plurality of cylinders each having an ignition coil, an ignition plug and a second switching element, in which the booster means, the first and the second condensers and the inductor are provided commonly with respect to the respective cylinders.

According to a third aspect of the present invention, there is provided an ignition device for an internal combustion engine according to the first or the second aspect, further comprising a current detecting means for detecting a current flowing in the first switching element, wherein the driving signal is broken each time a value of a current flowing in the first switching element reaches a predetermined value.

According to the first aspect of the present invention, the first switching element is maintained OFF during the predetermined period for maintaining discharge, and the current from the energy in the inductor flows to the primary side of the ignition coil through the booster coil.

Furthermore, according to the second aspect of the present invention, the current for maintaining discharge is supplied to the ignition coil without increasing the number of circuit elements, even for a multi-cylinder engine.

Furthermore, according to the third aspect of the present invention, the current flowing in the first switching element is limited thereby achieving the downsizing of the first switching element.

DETAILED DESCRIPTION OF THE PREFERRED EMBODIMENTS

Example 1

Figure 1:
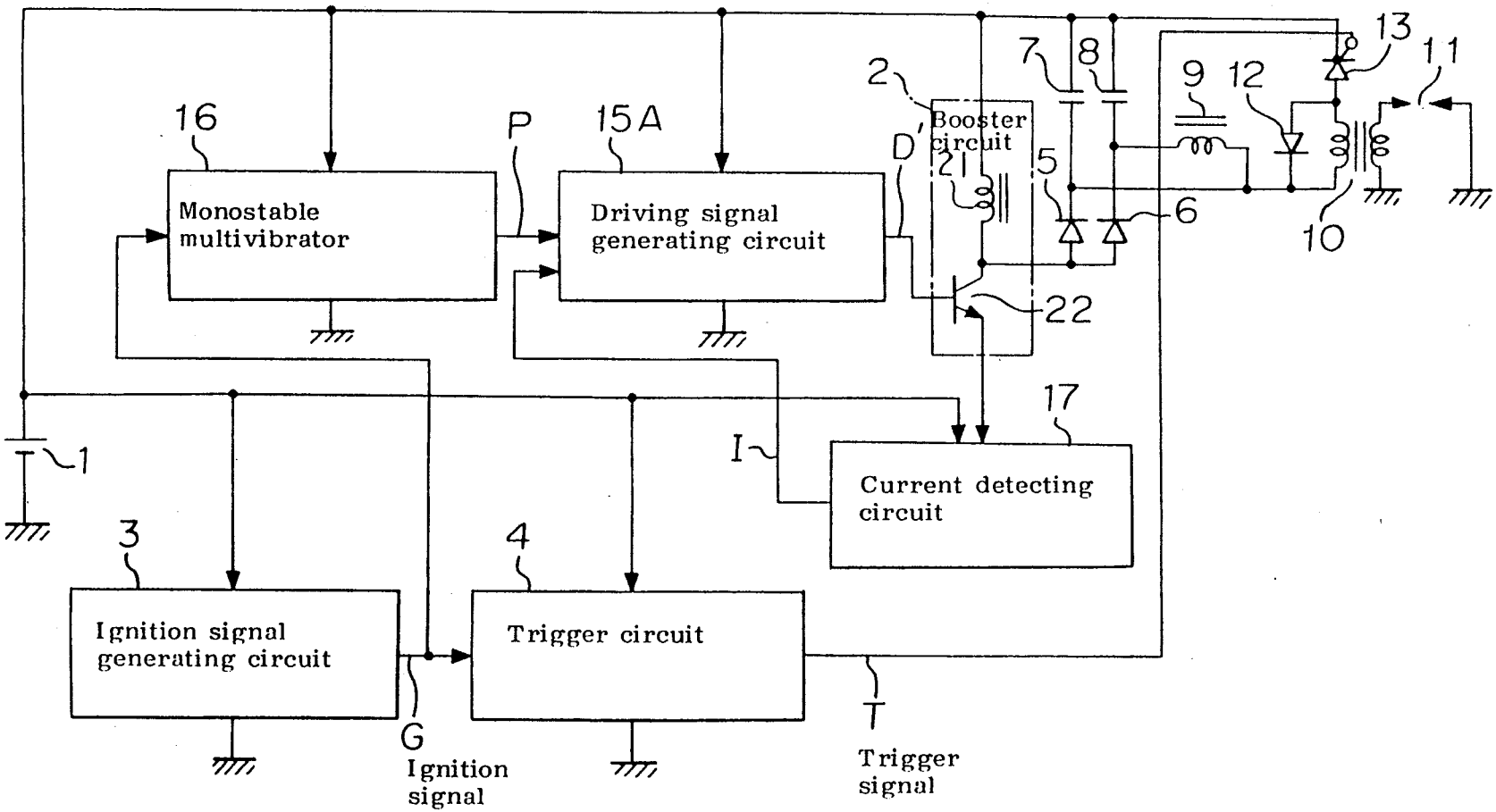
FIG. 1 is a construction diagram showing an embodiment of the present invention.

An explanation will be given of an embodiment of the present invention referring to the drawings as follows.

FIG. 1 is a construction diagram showing an embodiment of the present invention, wherein notations 1 through 13 are the same as before.

A notation 15A designates a driving signal generating circuit for forming a driving signal D' based on a delay pulse P and a current signal I (mentioned later), 16, a monostable multivibrator for forming the delay pulse P in synchronism with the rise of the ignition signal G and for inputting it to the driving signal generating circuit 15A, and 17, a current detecting circuit for detecting a current flowing in the power transistor 22, and inputting a current detecting signal I to the driving signal generating circuit 15A.

In this case, the monostable multivibrator 16 comprises a delay means for outputting the delay pulse P synchronized with the ignition signal G to the driving signal generating circuit 15A, and for preventing the ON-operation of the power transistor 22 during a time for maintaining discharge.

Figure 6:
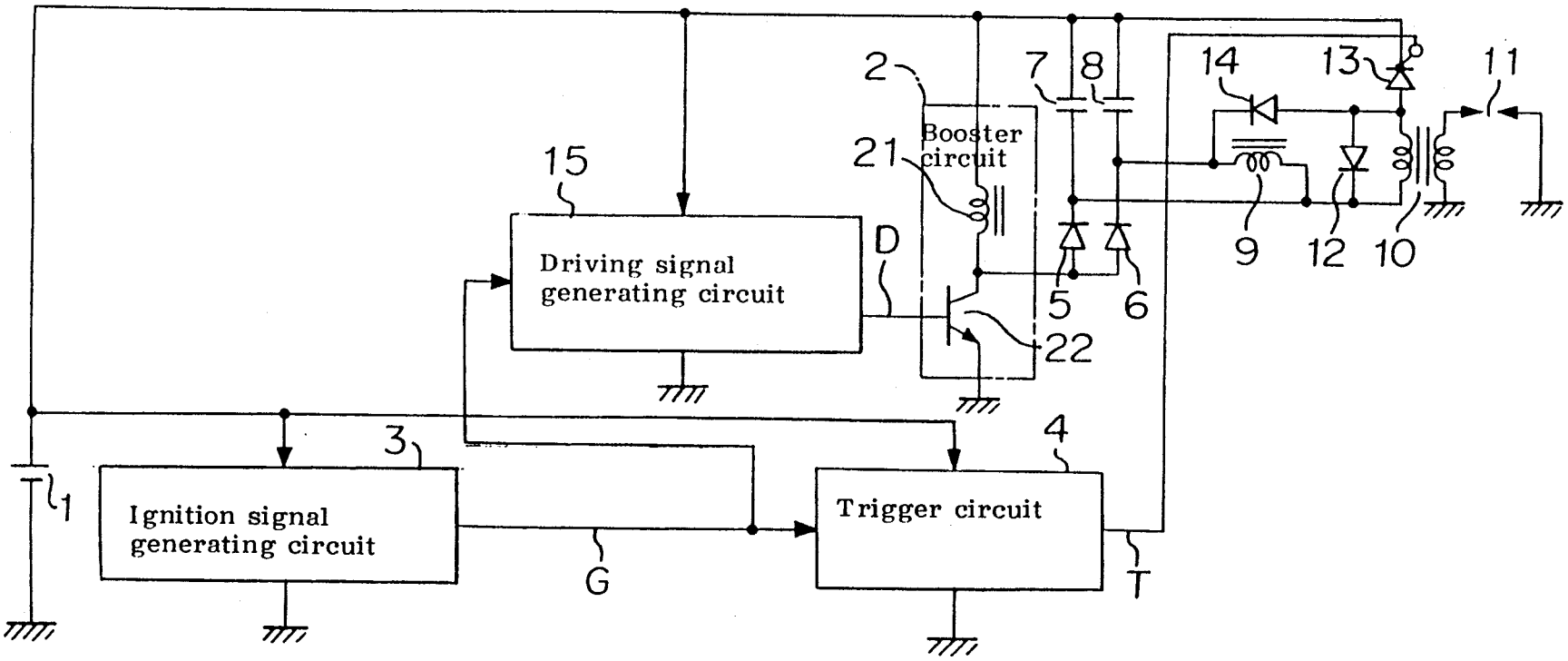
FIG. 6 is a construction diagram showing a conventional ignition device for an internal combustion engine.
Figure 7:
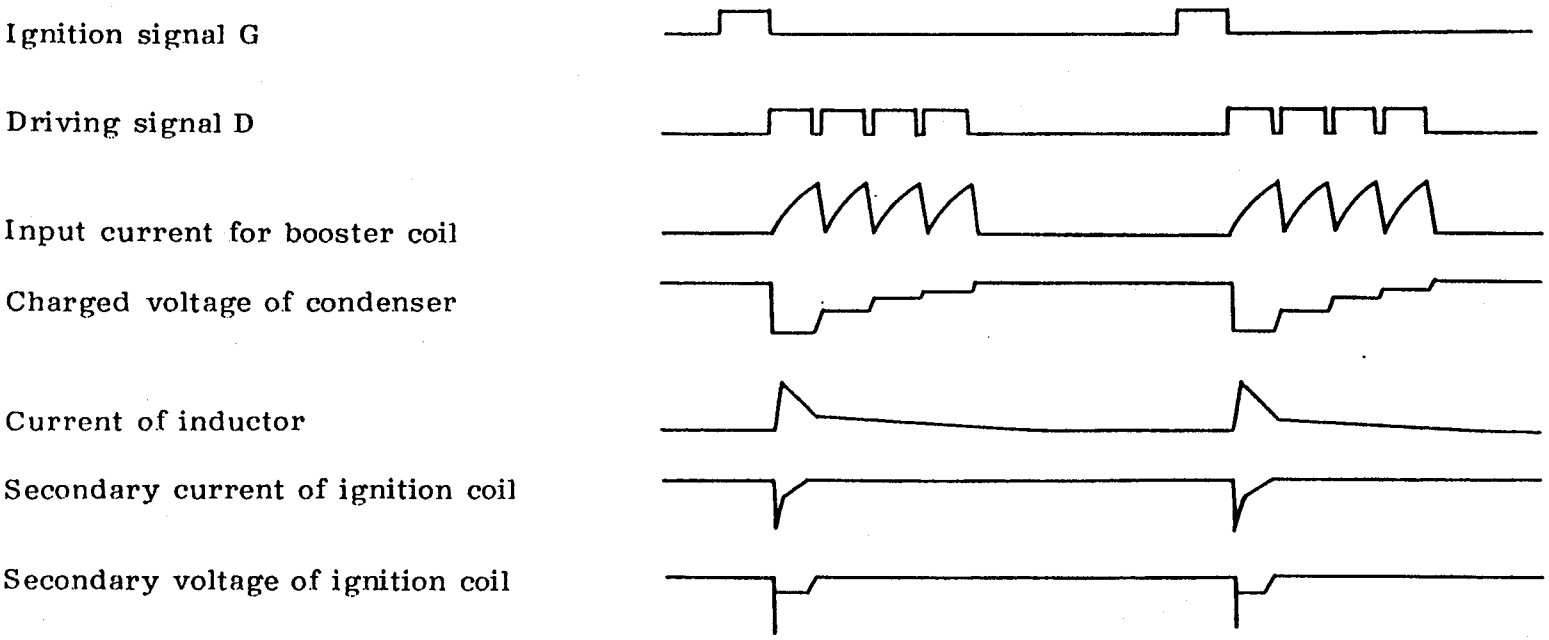
FIG. 7 shows wave diagrams for explaining the operation of the conventional ignition device for an internal combustion engine.

Furthermore, the diode 14 shown in FIG. 6 is removed, and the booster coil 21, the diode 6, the inductor 9, the primary side of the ignition coil 10 and the thyristor 13 form a closed circuit for maintaining or extending the discharge time.

Next, an explanation will be given of the operation of the embodiment shown in FIG. 1 referring to the waveform diagrams of FIG. 2.

First, as before, when the ignition signal G is formed by the ignition signal generating circuit 3, the trigger circuit 4 forms the trigger signal T which fires the thyristor 13, and the charged voltage of the condensers 7 and 8 is discharged through the primary side of the ignition coil 10 and thyristor 13, thereby generating a discharge at the ignition plug 11.

At this moment, the discharge energy of the condenser 8 is stored in the inductor 9, and the current in the inductor 9 flows through the closed circuit for maintaining discharge, that is, the primary side of the ignition coil 10, the thyristor 13, the booster coil 21 and the diode 6, thereby extending the time for maintaining the discharge of the plug 11. Furthermore, the thyristor 13 is not turned off while the current for maintaining discharge flows, since the conductivity maintaining current is provided.

On the other hand, it is necessary to flow an input current to the booster coil 21 by the driving signal D' for recharging the boosted voltage to the condensers 7 and 8 after discharge. The monostable multivibrator 16 forms the delay pulse P synchronized with the ignition signal G. The width of the delay pulse P is set to be longer than that of the ignition signal G by a time corresponding to the required time for maintaining discharge.

The delayed pulse P is inputted to the driving signal generating circuit 15A, and generates the driving signal D' at the fall of the delayed pulse P. Accordingly, the power transistor 22 is maintained OFF during the time period for maintaining discharge of the ignition plug 11. The current in the inductor 9 keeps flowing to the primary side of the ignition coil 10 through the booster coil 21 without flowing to ground through the power transistor 22 and the current detecting circuit 17.

Figure 2:
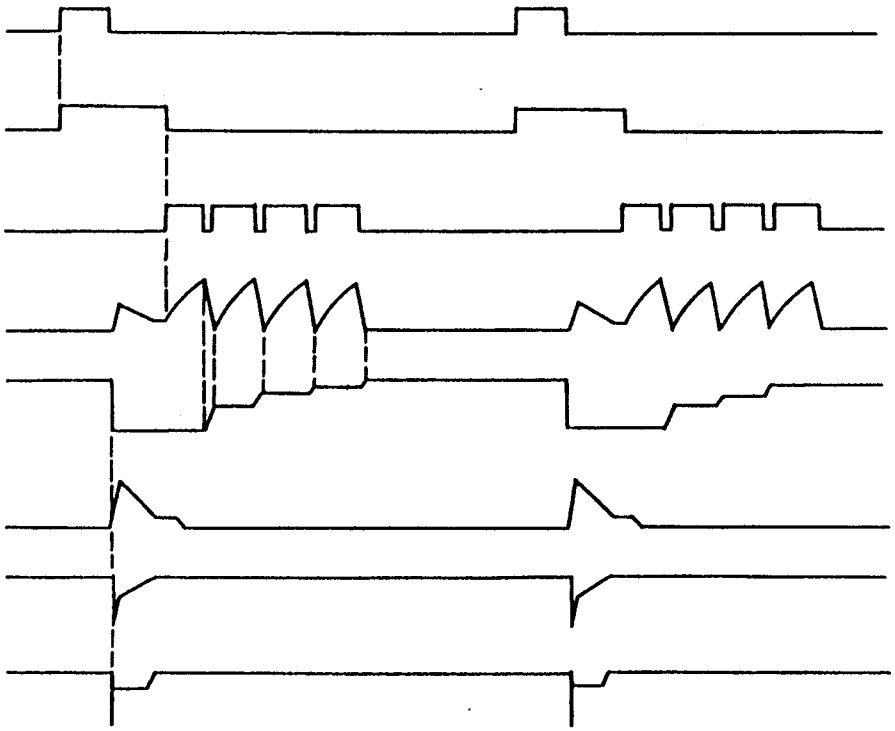
FIG. 2 shows waveform diagrams for explaining the operation of the embodiment of the present invention.

As shown in FIG. 2, the driving signal D' is not generated while the current flows in the secondary side of the ignition coil 10 generating a secondary voltage, and a current for maintaining discharge flows in the booster coil 21.

Furthermore, the driving signal generating circuit 15A, when the condensers 7 and 8 are charged by the driving signal D', breaks the driving signal D' every time the current in the power transistor 22 reaches a predetermined value, based on the current detecting signal I obtained by the current detecting circuit 17.

In this way, since the value of the input current to the booster coil 21 which is periodically broken is maintained constant, the charging of the condensers 7 and 8 is performed with certainty, and the value of the current flowing in the power transistor 22 is restricted. Accordingly, the power transistor 22 is not destroyed by an overcurrent, and downsizing of the power transistor 22 is achieved.

Furthermore, in the above Example, the value of the input current to the booster coil 21 is restricted to a constant value, based on the current detecting signal I from the current detecting circuit 17. However, when a current allowance value of the power transistor 22 is large, a driving signal D' having a predetermined period may be formed without utilizing the current detecting circuit 17.

Furthermore, an explanation has been given of the case wherein a single cylinder is driven. However, naturally this invention is applicable to the case wherein a plurality of cylinders are driven which are respectively provided with an ignition coil 10, an ignition plug 11 and a thyristor 13.

Example 2

Figure 3:
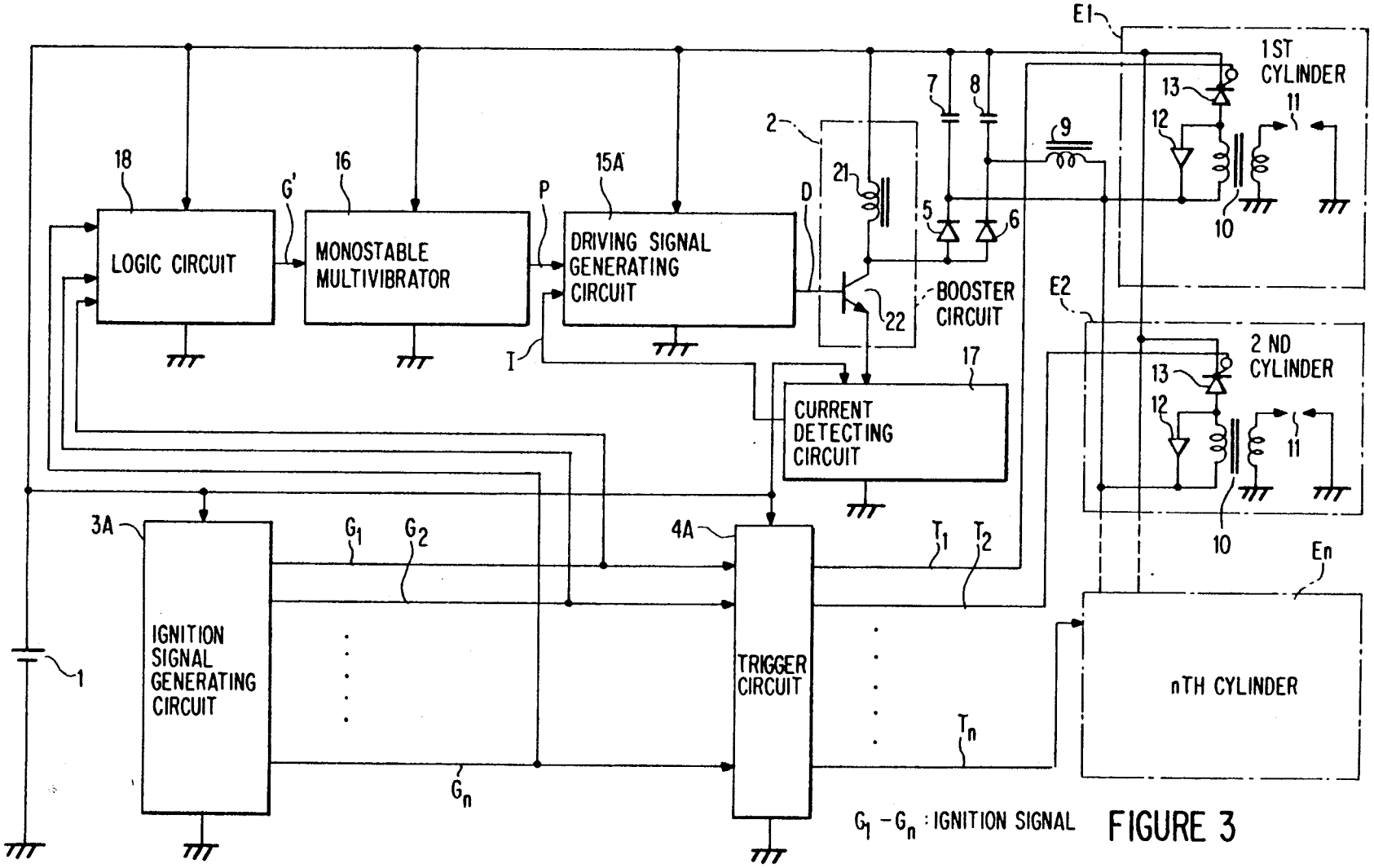
FIG. 3 is a construction diagram showing another embodiment of the invention.

FIG. 3 shows another embodiment of this invention. In this case, the current for maintaining discharge is supplied to the primary sides of the respective ignition coils 10 of multi-cylinders without increasing the number of circuit elements.

In FIG. 3, notations $E_1$ through $E_n$ designate a plurality of cylinders having the same construction, and an ignition signal generating circuit 3A and a trigger circuit 4A respectively form ignition signals $G_1$ through $G_n$ and trigger signals $T_1$ through $T_n$ for the respective cylinders $E_1$ through $E_n$. The booster circuit 2, the condensers 7 and 8 and the inductor 9 are commonly provided for the respective cylinders $E_1$ through $E_n$.

In this case, since the current for maintaining discharge flows through the individual thyristors 13 incorporated in the respective cylinders $T_1$ through $T_n$, this current is not supplied in parallel to circuits of the other cylinders.

Furthermore, the booster circuit 2 is utilized as a booster means, and the booster voltage is generated simply by repetitively supplying and terminating current to the booster coil 21. However, the booster voltage may be generated from a secondary side of a booster transformer by utilizing a DC-DC converter incorporating the booster transformer.

Figure 4:
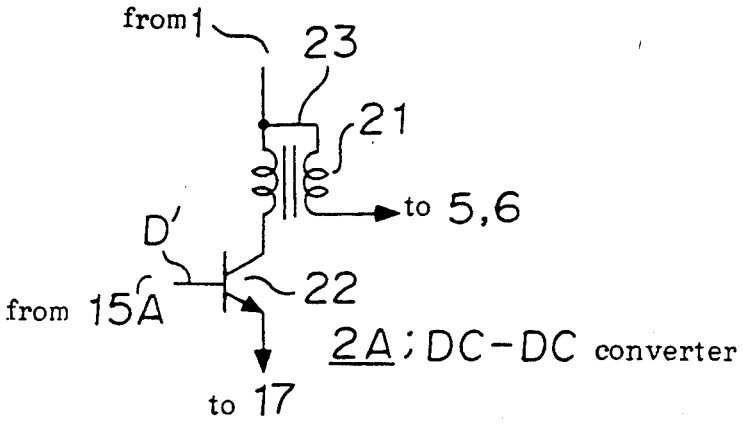
FIG. 4 is a circuit diagram showing another example of a booster circuit utilized in this invention.

For instance, as shown in FIG. 4, it is possible to utilize a DC-DC converter 2A having a common terminal with the positive pole side of the battery 1 instead of the booster circuit 2, as a booster means. In this case, the secondary side of the booster transformer 23 in the DC-DC converter 2A becomes the booster coil 21. The boosted voltage from the booster coil 21 is similarly charged to the condensers 7 and 8 through the diodes 5 and 6 (refer to FIG. 1).

Figure 5:
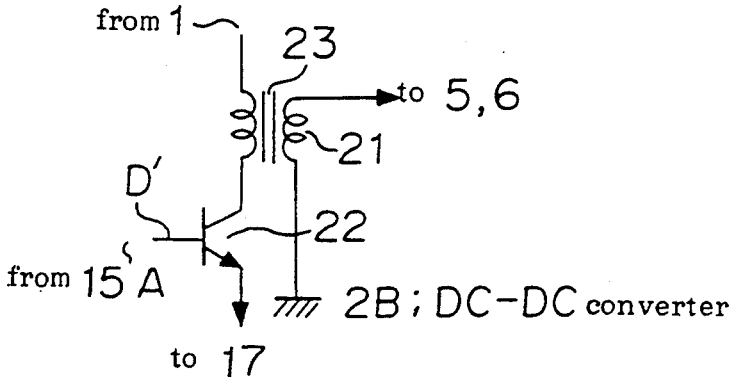
FIG. 5 is a circuit diagram showing another booster circuit utilized in the invention.

Furthermore, as shown in FIG. 5, it is possible to utilize a DC-DC converter 2B as a booster means having a common terminal on the ground side. In this case, the common terminal for forming a reference potential of the thyristor 13 and the condensers 7 and 8 (refer to FIG. 1) is connected to the ground side of the battery 1.

What is claimed is:

1. An ignition device for an internal combustion engine, comprising:

a booster means including a booster coil and a first switching element for generating a boosted voltage from the booster coil;

a driving signal generating circuit for forming a driving signal for driving the first switching element in response to an ignition signal;

a first and a second condenser for charging with the boosted voltage from the booster means;

an ignition coil having a secondary side to which an ignition plug is connected;

a second switching element forming a first closed circuit for discharge with the first condenser and a primary side of the ignition coil, said second switching element being turned on in synchronism with the ignition signal;

an inductor forming a second closed circuit with the second condenser, the primary side of the ignition coil and the second switching element;

a rectifying element connected to the primary side of the ignition coil;

wherein voltage is generated in the ignition coil by discharging the first and second condensers therethrough in synchronism with the ignition signal, and a discharge energy of the second condenser stored in the inductor is supplied to the primary side of the ignition coil thereby extending a discharge time at the ignition plug; and a delay means for preventing a turning on of the first switching element during the extended discharge time by outputting a delay pulse in synchronism with the ignition signal to the driving signal generating circuit, thus establishing a third closed circuit for maintaining the extended discharge time through the booster coil, the inductor, the primary side of the ignition coil and the second switching element.

2. The ignition device for an internal combustion engine according to claim 1, further comprising a plurality of cylinders each having an ignition coil, an ignition plug and a second switching element, in which the booster means, the first and the second condensers and the inductor are provided commonly with respect to the respective cylinders.

3. The ignition device for an internal combustion engine according to claim 1 or claim 2, further comprising a current detecting means for detecting a current flowing in the first switching element, wherein the driving signal is interrupted every time a current flowing in the first switching element reaches a predetermined value.

* * * * *